United States Patent [19]

Nikolaev et al.

[11] 4,299,293

[45] Nov. 10, 1981

[54] PERCUSSIVE TOOL ANGULAR POSITION DEVICE

[76] Inventors: Igor V. Nikolaev, ulitsa Fadeeva, 5, kv. 37; Anatoly I. Lednikov, Korovinskoe shosse, 9, korpus 2, kv. 51; Boris G. Goldshtein, ulitsa Molodogvardeiskaya, 24, korpus 1, kv. 26; Leonid A. Gornik, ulitsa Krasny Kazanets, 3, korpus 5, kv. 139, all of, Moscow, U.S.S.R.

[21] Appl. No.: 967,525

[22] Filed: Dec. 7, 1978

[30] Foreign Application Priority Data

Dec. 9, 1977 [SU] U.S.S.R. ..... 2552593

[51] Int. Cl.[3] ..... B25D 17/08

[52] U.S. Cl. ..... 173/104; 279/19; 267/180

[58] Field of Search ..... 173/104, 134, 139, 118, 173/130; 279/19, 23 R; 267/180, 174, 175

[56] References Cited

U.S. PATENT DOCUMENTS

| | | | |
|---|---|---|---|
| 1,796,487 | 3/1931 | Stevens | 173/134 |
| 2,890,455 | 6/1959 | Etzkorn | 173/139 X |
| 3,405,929 | 10/1968 | Kaplan | 267/180 |
| 3,885,634 | 5/1975 | Goppen et al. . | |
| 4,071,094 | 1/1978 | Kilin et al. | 173/139 |

FOREIGN PATENT DOCUMENTS

| | | | |
|---|---|---|---|
| 647626 | 12/1950 | United Kingdom | 279/19 |
| 1005019 | 9/1965 | United Kingdom . | |
| 1055048 | 1/1967 | United Kingdom . | |
| 1244370 | 9/1971 | United Kingdom . | |
| 276855 | 5/1969 | U.S.S.R. | 173/19 |

*Primary Examiner*—Werner H. Schroeder
*Assistant Examiner*—Andrew M. Falit
*Attorney, Agent, or Firm*—Lackenbach, Lilling & Siegel

[57] ABSTRACT

A percussive tool has a working tool mounted for reciprocations in a barrel. A collar is arranged between a shank and a working portion of the working tool. The shank of the working tool reciprocates in a guide bushing secured in the barrel to ensure reciprocations of the working tool. There is provided a member for determining the angular position of the working tool during the reciprocations, the member comprising either the barrel proper in case of concrete breakers, or a hood, e.g. in chipping hammers. For positively controlling the angular position of the working tool, there is provided a spring having two portions of different cross-sectional configuration, a first portion being coupled for a combined rotation to the member determining the angular position of trhe working tool, and a second portion being of a cross-sectional configuration corresponding to the cross-sectional configuration of the working portion of the working tool.

5 Claims, 8 Drawing Figures

FIG. 2
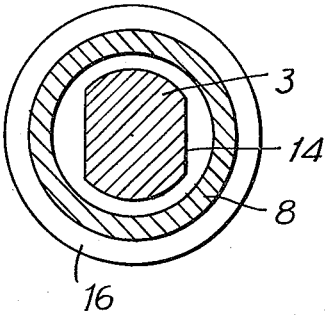
FIG. 3
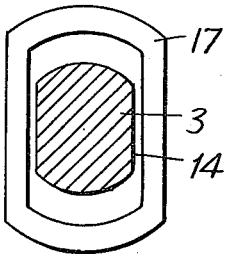
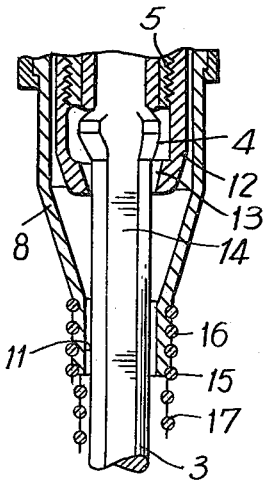
FIG. 5
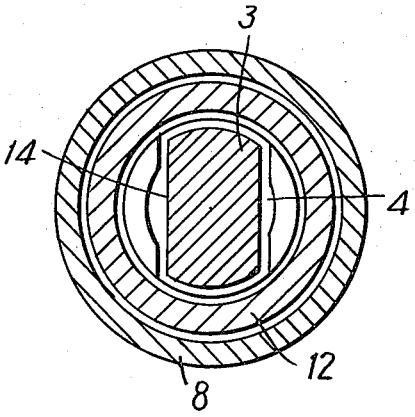
FIG. 4

PERCUSSIVE TOOL ANGULAR POSITION DEVICE

The invention relates to percussive tools and may be most successfully used in chipping hammers and concrete breakers.

Widely known percussive tools comprise a barrel having means for retaining a working tool, and means for causing reciprocations of the working tool to accomplish a desired work. The working tool is generally provided with a shank which is mounted in the barrel by means of a guide bushing, a working portion, and a collar arranged therebetween. One of the problems associated with the operation of such tools resides either in fixing the angular position of the working tool during its reciprocations, or controlling the angular position thereof during operation. For that purpose, percussive tools, in which it is required to have a predetermined angular position of the working tool, are provided with special means performing this function.

Thus, during operation with a concrete breaker, the working tool should be in a predetermined angular position relative to the barrel, that is it should not rotate relative thereto when the barrel is not turned, and should rotate with the barrel when the latter is turned.

In other words, in concrete breakers, the means determining the angular position of the working tool comprises the barrel proper.

Known in the art is a concrete breaker disclosed in British Pat. No. 1,005,019, in which the barrel has a guide bushing with a bore of a non-circular cross-section, and the shank of the working tool also has a non-circular cross-sectional configuration corresponding to that of the bushing bore. The concrete breaker also has a device for retaining the working tool, which comprises a sleeve having a slit and connected to the barrel by means of a spring which reduces vibrations during idle hammering of the collar of the working tool against the sleeve. A disadvantage of this concrete breaker resides in a complicated manufacturing process as the guide bushing and the working tool shank should be non-circular in cross-section, e.g. square or hexagonal.

Known in the art is another percussive tool—concrete breaker—disclosed in British Pat. No. 1,055,048, in which the shank of the working tool and the guide bushing have a square cross-sectional configuration, aand the tool is retained by means of two half-sleeves which are received in a bore of the front end portion of the barrel and locked by means of a rubber sleeve providing the sealing; the interconnection of the half-sleeves and rubber sleeve, on the one hand, and the rubber sleeve and barrel, on the other hand, being effected by means of respective grooves and projections mating with an elastic engagement. A disadvantage of this construction, apart from the complicated manufacture of the working tool and guide bushing, resides in a low reliability of the device for retaining the working tool as the rubber sleeve is rapidly worn.

Finally, known in the art is a concrete breaker disclosed in British Pat. No. 1,244,370, in which the guide bushing has a hexagonal bore merging into a round bore, and the shank has a corresponding cross-sectional shape, the tool being retained by means of a rubber-metal sleeve secured to the barrel. The provision of the round portion of the bore of the guide bushing is necessary to ensure the sealing of the workstroke chamber of the barrel. A disadvantage of the construction resides in the complicated manufacture of the guide bushing and working tool; moreover, the metal-rubber sleeve fails to provide an adequate protection against fallout of the tool.

All the above-described percussive tools have a common disadvantage residing in that the angular position of the working tool during operation is determined by the barrel through the intermediary of the guide bushing having a non-circular bore. This requires a labor-comsuming machining of the bore of the guide bushing and shank of the working tool and results in additional metal losses.

During operation with a chipping hammer, it is necessary to change the angular position of the working tool in operation to improve the productivity.

Known in the art is a chipping hammer disclosed in U.S. Pat. No. 3,885,634, comprising a casing accommodating an axially movable barrel having a guide bushing for reciprocations of a shank of a working tool therein. The chipping hammer has a means for controlling the angular position of the working tool during operation, comprising a hood arranged on the casing and having a non-circular hole shapped similarly to the cross-sectional configuration of the working portion of the working tool. The hood is a means determining the angular position of the working tool in operation. The working tool is retained by means of a lock secured to the front end portion of the barrel and also having a non-circular hole shaped similarly to the cross-sectional configuration of the working portion of the working tool and collar thereof. This construction ensures a rapid insertion of the working tool, protects the left hand of the operator against harmful effect of vibrations, and also considerably reduces the safety hazards for the operator. However, in operation with such chipping hammer, high friction of the working tool within the non-circular hole of the hood results in an overheating of the working tool and transmission of vibrations to the left hand of the operator through the hood. Reduction of friction and vibrations by installing rollers in the hood hole is associated with complication of the design and requires high strength at the points of installation of the rollers in the hood body.

Therefore, it will be apparent that percussive tools known heretofore, in which either fixing of, or controlling the angular position of the working tool is required, either have a complicated construction or do not offer an adequate operational reliability and safety.

It is an object of the invention to provide a percussive tool in which high operational reliability is ensured with a simple configuration of the shank of the working tool and of the bore of the guide bushing.

Another object of the invention is to provide a percussive tool having a reduced level of vibration.

Still another object of the invention is to provide a concerete breaker in which the working tool has a round shank, and the guide bushing has a round bore along the entire length thereof.

Finally, it is an object of the invention to provide a chipping hammer in which friction between the working tool and the hood, and level of vibration transmitted from the working tool to the hood are reduced.

These and other objects are accomplished by a percussive tool comprising a working tool mounted for reciprocations in a barrel and having a shank, a working portion, and a collar arranged therebetween, a guide bushing for reciprocations of the shank of the working tool therein, and a means determining the angular position of the working tool during the reciprocations thereof. According to the invention, there is provided an elastic member for positively controlling the angular position of the working tool depending on the position of the means determining the angular position of the working tool, the elastic member having two portions of different cross-sectional configuration, of which a first portion is coupled for a combined rotation to the means determining the angular position of the working tool, and a second portion is of a non-circular cross-sectional configuration corresponding to the cross-sectional configuration of the working portion of the working tool.

The advantage of the percussive tool of the present invention resides in that the use of the elastic member of the above described shape provides, on the one hand, the employment of a working tool having a round shank and a simplified construction of the guide bushing, and on the other hand, reduction of friction and vibrations.

In accordance with one aspect of the invention, there is provided a percussive tool in which the means determining the angular position of the working tool comprises a hood coupled to a casing and rotatable relative thereto, and the working tool is mounted in the barrel reciprocating in the casing, the first portion of the elastic member being coupled to the hood. With such a construction of the percussive tool, friction between the working tool and the hood is reduced, and vibration level at the hood is lowered. A chipping hammer is an example of such percussive tool.

In accordance with another aspect of the invention, there is provided a percussive tool in which the means determining the angular position of the working tool is a barrel, the first portion of the elastic member being mounted on the barrel, the guide bushing has a round bore along the entire length thereof, and the working tool has a round shank. At least one cross-sectional dimension of the second portion of the elastic member is preferably smaller than one cross-sectional dimension of the collar. An example of such percussive tool is a concrete breaker.

The elastic member is preferably made in the form of a coiled spring.

The invention will now be described, by way of example only, with reference to the accompanying drawings, in which:

FIG. 2 is a sectional view taken along the line II—II in FIG. 1;

FIG. 3 is a sectional view taken along the line III—III in FIG. 1;

FIG. 4 is a sectional view taken along line IV—IV in FIG. 1;

FIG. 5 is a partial view, in a longitudinal section of the pneumatic chipping hammer shown in FIG. 1 (turned 90°)

Figure 1:
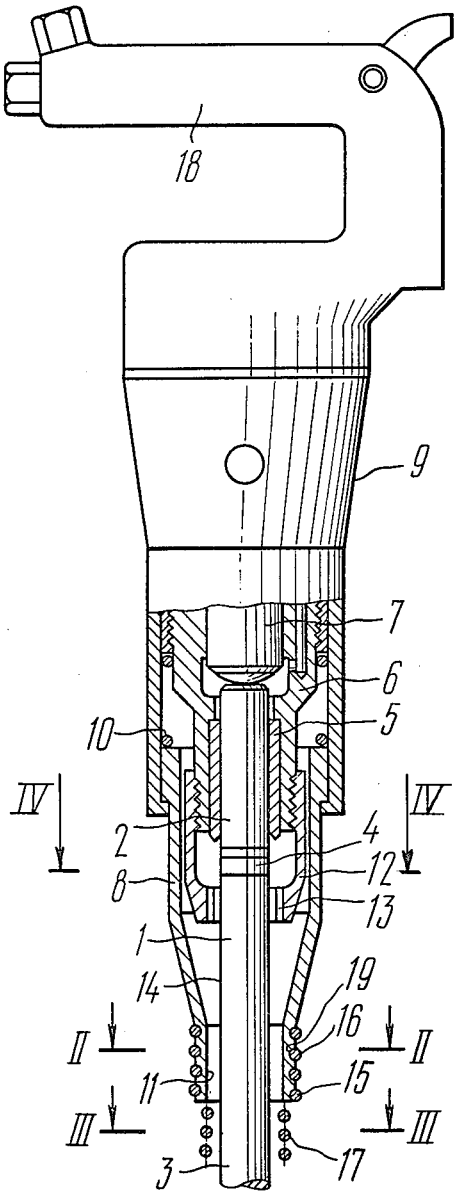
FIG. 1 shows a pneumatic chipping hammer, partially in section, according to the invention.

A percussive tool according to the invention comprises a working tool 1 (FIGS. 1, 4) having a shank 2, a working portion 3, and a collar 4 arranged therebetween. The shank 2 of the working tool 1 is mounted for reciprocations in a guide bushing 5 which is secured in a barrel 6. The barrel 6 accommodates means for causing the reciprocations of the working tool 1, including a hammer 7 and an air distribution arrangement (not shown). This arrangement is well known to those skilled in the art and does not constitute a material part of the invention.

FIG. 1 shows a pneumatic chipping hammer constructed in accordance with the invention. In this hammer, a means determining the angular position of the working tool 1 during the reciprocations thereof comprises a hood 8 mounted in a casing 9 for rotation and axial movement relative thereto. The hood is held in the working position by means of a spring 10 arranged between the hood 8 and casing 9. The casing 9 surrounds the barrel 6 and is axially movable relative thereto. A hole 11 in the front end portion of the hood 8 allows a free passage of the working tool 1 and its collar 4. A lock 12 is rotatably mounted on the barrel 6 and has a non-circular hole 13 in its front end wall. The working tool 1 has flats 14 along the entire length of the working part 3 and collar 4, the shape and dimensions of the hole 13 of the lock 12 and the cross-sectional shape and dimensions of the working tool 1 in the zone of the collar 4 corresponding to one another so that the working tool 1 passes freely through the lock 12, and its shank 2 enters into the bore of the guide bushing 5. The shank 2 of the working tool 1 has a round cross-section.

FIG. 1 shows the position of the working tool 1 inserted into the chipping hammer. Upon insertion, the working tool 1 is turned in such a manner that the collar 4 cannot pass back through the hole 13 of the lock 12. The hood 8 is coupled to the lock 12 in such a manner (not shown) that, after the working tool 1 is inserted, the lock 12 is rotated upon turning the hood 8 thus preventing the fallout of the working tool as will be described later. The arrangement coupling the lock to the hood is not described herein in detail as it is immaterial for the invention. This arrangement in disclosed in U.S. Pat. No. 3,885,634.

In accordance with the invention, the chipping hammer has an elastic member 15 (FIG. 1) for positively controlling the angular position of the working tool 1 during its reciprocations. In this specific embodiment the elastic member comprises a coiled spring. The elastic member 15 has two portions of different cross-sectional configuration. A first portion 16 (FIGS. 1,2) is coupled for a combined rotation of the means determining the angular position of the working tool 1, that is to the hood 8 and has round or any other cross-sectional configuration corresponding to the shape of the outer periphery of the hood. A second portion 17 is of a cross-sectional configuration corresponding to that of the working portion 3 of the working tool 1 (FIGS. 1, 3). It is apparent that upon turning the means determining the angular position of the working tool, that is upon turning the hood 8, the working tool 1 will also turn owing to the engagement of the second portion 17 of the elastic member 15 for positively controlling the angular position of the working tool with the working portion 3 of the working tool 1.

As described above, when inserting the working tool 1 into the hammer, the working tool 1 is caaused to rotate by turning the hood 8. Then, owing to the fact that with the hammer in the operative position the non-circular holes of the lock 12 and elastic member 15 will never be in register due to the above-mentioned coupling of the lock 12 to the hood 8, the fallout of the working tool 1 from the hammer is prevented.

In operation, the operator holds the chipping hammer by the right hand at a handle 18, and by the left hand, at the hood 8 to control the angular position of the working tool 1. The working tool 1 reciprocates under the action of the hammer 7.

Owing to the elasticity of the member 15 which, as mentioned above, is made in the form of a coiled spring, not strong friction occurs between the working tool 1 and the elastic member 15 upon misalignment of the working tool 1 relative to the longitudinal axis of the hood 8, the elastic member compensating for the misalignment; moreover, the transmission of vibrations from the working tool 1 to the hood 8 is reduced thereby additionally protecting the left hand of the operator against vibration.

With such construction of the chipping hammer its manufacture is simplified as the hole 11 is round and machined with a free tolerance, and the fastening of the elastic member 15 to the hood 8 is not restricted by any strength requirements. The elastic member may be secured to the hood 8 by providing a helical groove 19 on the outer periphery of the hood 8, and is held against rotation relative to the hood, e.g. by inserting a bent away end of the spring (at the first portion 16 of the elastic member 15) into a hole in the wall of the hood 8, or by any other suitable means (not shown).

Figure 6:
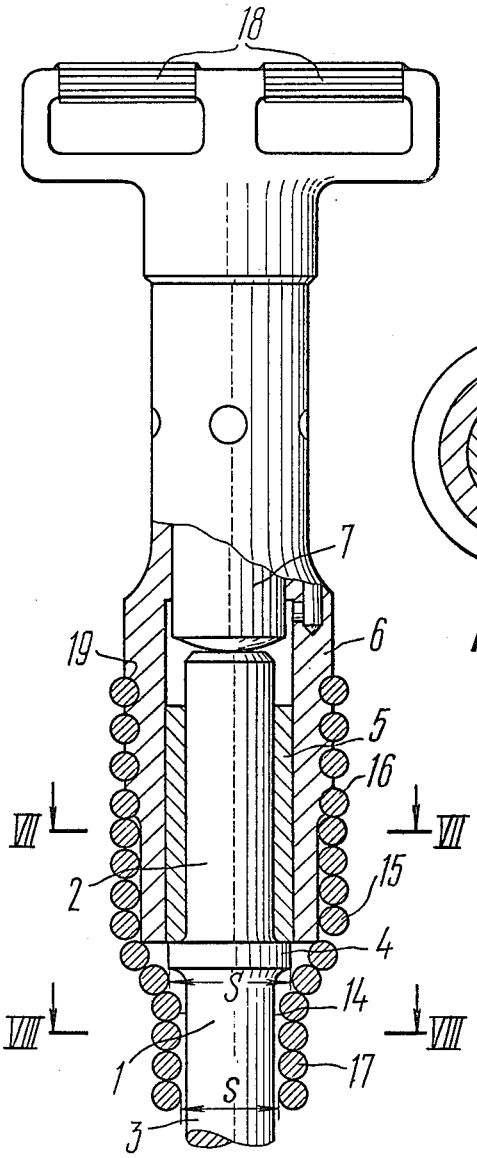
FIG. 6 shows a pneumatic breaker, partially in section, according to the invention.
Figure 7:
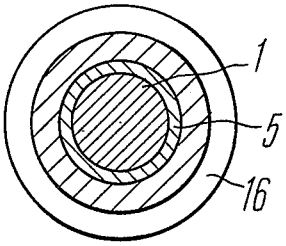
FIG. 7 is a sectional view taken along the line VII—VII in FIG. 6.
Figure 8:
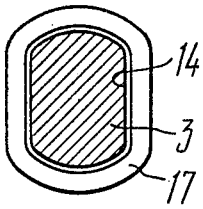
FIG. 8 is a sectional view taken along the line VIII—VIII in FIG. 6.

FIG. 6 shows a pneumatic concrete breaker according to the invention, all parts similar to the parts of the chipping hammer being indicated by the same reference numerals.

In the concrete breaker shown in FIG. 6, the means determining the angular position of the working tool 1 is the barrel 6, and the elastic member 15 for positively controlling the angular position of the working tool 1 has the first portion 16 coupled to the barrel 6 for a combined rotation in the same manner as the similar first portion 16 of the elastic member 15 shown in FIG. 1 is coupled to the hood 8 of the chipping hammer.

The working tool 1 has the round shank 2 received in the guide bushing 5 secured in the barrel 6 and having a round bore along the entire length thereof.

At least one cross-sectional dimension of the second portion 17 of the elastic member 15 is smaller than one cross-sectional dimension of the collar 4 of the working tool 1 thus retaining the working tool 1 in the barrel 6.

To insert the working tool 1 into the barrel 6, it is necessary to remove the elastic member 15 from the barrel 6, insert the shank 2 of the working tool 1 into the guide bushing 5, and then, while holding the working tool 1 by hand, to put the elastic member 15 on the barrel 6 and fix against rotation as described above.

In operation, the operator holds the concrete breaker at the handles 18, and the working tool 1 reciprocates under the action of the hammer 7. By turning the barrel 6 which comprises the means determining the angular position of the working tool 1, the operator can turn the working tool 1, whereas with the barrel 6 remaining in the same angular position, the working tool 1 remains strictly oriented relative to the handles 18. This occurs owing to the engagement of the flats 14 of the working portion 3 of the working toll 1 with the second portion 17 of the elastic member 15 which is of a non-circular cross-sectional configuration corresponding to that of the working portion 3 of the working tool 1.

Therefore, in addition to its main function—retaining of the tool and vibrations reduction at the barrel, the elastic member 15 positively controls the angular position of the working tool 1. The concrete breaker construction is greately simplified, the tool having the guide bushing with the round bore along the entire length thereof, and the working tool is also simpler in manufacture.

The elastic member 15 (FIGS. 1,6) is simple in manufacture. It comprises a coiled spring and may be made either by winding on a mandrel having two portions of different cross-sectional configuration corresponding to the cross-sectional configuration of the two respective portions of the elastic member 15, or by pressing a portion of a round coiled spring.

While the invention was described hereinabove as applied to chipping hammers and concrete breakers, it will be apparent to those skilled in the art that it may also be used for other percussive tools in which the angular position of the working tool should be controlled.

What is claimed is:

1. A percussive tool comprising a barrel; a working tool mounted for reciprocations in said barrel and having a shank, a working portion, and a collar arranged therebetween; a guide bushing secured in said barrel, said shank of the working tool reciprocating in said guide bushing; means for determining the angular position of said working tool during said reciprocations; an elastic member for positively controlling the angular position of said working tool depending on the position of said means determining the angular position of the working tool, said elastic member having a first portion and a second portion; means for coupling said first portion of the elastic member to said means for determining the angular position of said working tool for a combined rotation, said second portion of said elastic member having a non-circular cross-sectional configuration, and said working portion of said working tool having a cross-sectional configuration corresponding to the cross-sectional configuration of said second portion of the elastic member to thereby result in coupling between said second portion of said elastic member and said working portion to provide combined rotation; and means for causing said reciprocations of said working tool.

2. A tool according to claim 1, wherein said elastic member comprises a coiled spring.

3. A percussive tool comprising a casing; a barrel mounted for reciprocations in said casing; a working tool mounted for reciprocations in said barrel and having a shank, a working portion, and a collar arranged therebetween; a guide bushing secured in said barrel, said shank of the working tool reciprocating in said guide bushing; means for determining the angular position of said working tool during said reciprocations, said means being mounted in said casing for rotation relative thereto; an elastic member for positively controlling the angular position of said working tool depending on the position of said means determining the angular position of said working tool, said elastic member having a first portion and a second portion; means for coupling said first portion of the elastic member to said means for determining the angular position of said working tool for a combined rotation, said second portion of said elastic member being of a non-circular cross-sectional configuration, and said working portion of said working tool being of a cross-sectional configuration corresponding to the cross-sectional configuration of said second portion of said elastic member to thereby result in coupling between said second portion of said elastic member and said working portion to provide combined rotation; and means for causing said reciprocations of said working tool.

4. A percussive tool comprising a barrel; a working tool mounted in said barrel for reciprocations and having a round shank, a working portion, and a collar arranged therebetween; a guide bushing secured in said barrel and having a round bore along the entire length thereof, said shank of said working tool reciprocating in said guide bushing; means for determining the angular position of said working tool during said reciprocations, said means comprising said barrel; an elastic member for positively controlling the angular position of said working tool depending on the position of said barrel, said elastic member having a first portion and a second portion; means for coupling said first portion of the elastic member to said barrel for a combined rotation, said second portion of said elastic member being of a non-circular cross-sectional configuration, and said working portion of said working tool being of a cross-sectional configuration corresponding to the cross-sectional configuration of said second portion of the elastic member to thereby result in coupling between said second portion of said elastic member and said working portion to provide combined rotation; and means for causing said reciprocations of said working tool.

5. A tool according to claim 4, wherein at least one cross-sectional dimension of said second portion is smaller than one cross-sectional dimension of said collar of the working tool.

* * * * *